US008230533B2

(12) United States Patent
Jorsch et al.

(10) Patent No.: US 8,230,533 B2
(45) Date of Patent: Jul. 31, 2012

(54) TOILET BOWL DISCHARGE VALVE ASSEMBLY

(75) Inventors: Thomas C. Jorsch, Sheboygan, WI (US); Benjamin W. Marotz, Kohler, WI (US); Charles R. Kopplin, Sheboygan, WI (US); Jeffrey F. Tempas, Oostburg, WI (US)

(73) Assignee: Kohler Co., Kohler, WI (US)

( * ) Notice: Subject to any disclaimer, the term of this patent is extended or adjusted under 35 U.S.C. 154(b) by 979 days.

(21) Appl. No.: 11/525,494

(22) Filed: Sep. 22, 2006

(65) Prior Publication Data

US 2008/0072372 A1 Mar. 27, 2008

(51) Int. Cl.
*E03D 11/10* (2006.01)

(52) U.S. Cl. ..... 4/434; 4/438; 4/440

(58) Field of Classification Search ..... 4/434–442
See application file for complete search history.

(56) References Cited

U.S. PATENT DOCUMENTS

| | | | | | |
|---|---|---|---|---|---|
| 168,613 | A | | 10/1875 | Carr | |
| 209,996 | A | | 11/1878 | Wellington | |
| 234,570 | A | * | 11/1880 | Hellyer | 4/438 |
| 258,454 | A | | 5/1882 | Mansur | |
| 279,048 | A | | 6/1883 | Tweeddale | |
| 283,172 | A | | 8/1883 | Walsh | |
| 289,495 | A | | 12/1883 | Bennor | |
| 299,333 | A | * | 5/1884 | Birkett | 4/438 |
| 717,651 | A | | 1/1903 | Allen | |
| 1,126,937 | A | * | 2/1915 | Barnstead | 4/222 |
| 2,883,147 | A | * | 4/1959 | Mirza et al. | 251/172 |
| 3,214,772 | A | * | 11/1965 | Roberts et al. | 4/438 |
| 3,599,248 | A | | 8/1971 | Fulton et al. | |
| 3,663,970 | A | | 5/1972 | Drouhard, Jr. et al. | |
| 3,885,771 | A | * | 5/1975 | Baumann | 251/298 |
| 3,902,694 | A | | 9/1975 | Friedell | |
| 3,904,170 | A | * | 9/1975 | Curran | 251/152 |
| 3,922,729 | A | * | 12/1975 | Ashley | 4/331 |
| 3,926,407 | A | | 12/1975 | Forster et al. | |
| 4,016,609 | A | | 4/1977 | Graham | |
| 4,155,129 | A | * | 5/1979 | Russell | 4/429 |
| 4,164,343 | A | | 8/1979 | Graebner | |
| 5,101,853 | A | * | 4/1992 | Mailliet et al. | 137/242 |

(Continued)

FOREIGN PATENT DOCUMENTS

CN 2533164 Y 1/2003

(Continued)

OTHER PUBLICATIONS

An undated photograph of an admitted prior art Hayward ball valve regulating linear flow with an axially rotatable ball.

(Continued)

*Primary Examiner* — Dinh Q Nguyen
*Assistant Examiner* — Chee-Chong Lee
(74) *Attorney, Agent, or Firm* — Foley & Lardner LLP

(57) ABSTRACT

Disclosed are trap valve assemblies for controlling flow from a toilet bowl to a trap way. In one form there is a cartridge unit positionable immediately below a toilet bowl discharge outlet. It has a pivotable gate in a form of a spherical segment. The gate has an eccentric pivoting motion so that it can swing from an open position to a blocking/closing position in which it fully contacts a sealing gasket. The spherical segment has a leading edge which is approximately between +40° and −40° from vertical when the gate is in an open position, to minimize the energy required to close the gate. In another form a ball and socket connection to the gate valve facilitates sealing.

13 Claims, 6 Drawing Sheets

U.S. PATENT DOCUMENTS

| | | | | |
|---|---|---|---|---|
| 5,345,618 | A * | 9/1994 | Sigler et al. | 4/321 |
| 6,212,700 | B1 | 4/2001 | Giesler et al. | |
| 6,332,229 | B1 | 12/2001 | O'Malley et al. | |
| 6,467,101 | B1 * | 10/2002 | Artola | 4/435 |
| 7,284,286 | B1 | 10/2007 | Kopplin et al. | |
| 2001/0052147 | A1 | 12/2001 | Lee | |
| 2005/0211942 | A1 | 9/2005 | Koester et al. | |
| 2008/0047053 | A1 * | 2/2008 | Grech et al. | 4/438 |

FOREIGN PATENT DOCUMENTS

| | | | |
|---|---|---|---|
| EP | 1124021 | | 8/2001 |
| FR | 359559 | A | 3/1906 |
| GB | 601812 | A | 5/1948 |
| JP | S49-25244 | | 3/1974 |
| JP | S56-134977 | | 10/1981 |
| JP | S63-45889 | | 3/1988 |
| JP | H6-33505 | | 5/1997 |
| SU | 1036764 | | 8/1983 |
| WO | WO 93/11311 | * | 6/1993 |
| WO | WO97/41315 | A1 | 11/1997 |

OTHER PUBLICATIONS

An undated photograph of an admitted prior art DependoDrain ball valve in exploded form.

4 pages of a Nov. 20, 2009 PCT search report from PCT/US2007/019914, a corresponding PCT application.

Mar. 23, 2010 Russian office action in a corresponding case, together with a translation thereof.

12 pages of an PCT ISR dated Apr. 1, 2010 in the corresponding PCT/US 2007/019914.

Publication and International Search Report of WO 2008/039035; publication date: Apr. 3, 2008; 26 pages.

European Examination Report for Application No. 07 838 161.3; dated Jul. 9, 2009; 3 pages.

International Preliminary Report on Patentability of PCT/US2007/019906; dated Mar. 24, 2009; 8 pages.

* cited by examiner

TOILET BOWL DISCHARGE VALVE ASSEMBLY

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

The present invention relates to toilets, and more particularly to valves controlling the outflow of waste from a toilet bowl to a toilet trap.

Although flushing type toilets aid in the sanitary disposal of human excrement, their level of water usage is of concern. A typical toilet includes a valve upstream of the toilet bowl, such as at the bottom of a water storage tank. When the toilet is flushed, the valve in such a water tank opens, and the tank water is able to flush into the toilet bowl.

However, with these conventional toilets, there is typically a delay between the beginning of the flushing cycle and the time that most of the crude waste has been removed from the bowl. Thus, there can be an undesirably large amount of flushing water required to just move the main waste out of the bowl, and a further amount is needed to provide the final rinse.

One approach for reducing this level of water usage is to provide an outlet valve immediately downstream of the toilet bowl outlet that is configured such that when it is opened most of the waste in the bowl can drop out of the bowl regardless of any new flush water entering the bowl. An example of this approach is depicted in U.S. Pat. No. 279,048.

However, such valves sometimes result in clogging, maintenance or wear problems. Also, they may be expensive to produce or install, or be unreliable over prolonged use, particularly when closure is directly into the face of the bowl discharge outlet flow.

U.S. Pat. No. 5,345,618 teaches a trap valve connected to a toilet bowl discharge outlet where a sphere segment gate is caused to rotate on an axis that is also the center of radius for the sphere. This provides a sliding closure of the discharge outlet. A problem with this design is that as the spherical gate rotates across the sealing element or gasket, the gate is continuously abrading the gasket, which wears the gasket and can lead to a loss of fluidic seal at the valve gate. Further, the bowl outlet which is closed by the gate, is positioned in a horizontal plane which causes the leading edge of the gate to start closing the orifice from an approximate 9 o'clock position to beyond a 3 o'clock position. This involves some movement during the closure against the gravity force of the bowl waste.

Other examples of trap valves and valves with sphere segment gates are disclosed in U.S. Pat. Nos. 289,495, 3,214,772, 3,599,248, 3,885,771, 3,926,407, 4,164,343, 6,212,700, 5,345,618, 6,332,229; as well as U.S. patent application 2005/0211942. However, notwithstanding these developments, a need still exists for improved toilet trap valve assemblies, particularly those which facilitate flushing with reduced amounts of water.

SUMMARY OF THE INVENTION

In one aspect the present invention provides a toilet having a bowl with a lower discharge outlet, a trap in fluid communication with the discharge outlet, and a trap valve positioned to control outflow from the discharge outlet to the trap. The trap valve has a valve housing having an entry, an exit, and a cavity connecting the entry and exit.

There is a gate valve positioned in the cavity and pivotable using linkage that extends from outside the housing to the gate valve. There is also a sealing gasket (preferably positioned adjacent the entry), so that the gate valve is pivotable from a first position blocking the entry and essentially closing off outflow from the discharge outlet, to a second position permitting flow from the discharge outlet to the trap, and so that the gate valve can begin closing off the entry when a lead edge of the gate valve is within 25° of vertical.

In preferred forms the valve housing is in the form of a cartridge having two clamshell parts defining the cavity. The gate valve can be in the form of a spherical segment having a radius of curvature extending from a center of curvature, such that the gate valve is pivotable about a center of rotation offset from said center of curvature.

Pivoting of the gate valve can be initiated as part of a flush cycle of the toilet, and the trap can have a normal trap water level to restrict back flow of sewer gases to the bowl, where the gate valve is positioned so as to be above that water level.

In another aspect the invention provides such a trap valve, albeit particularly where it is in the form of a cartridge suitable to be connected at one end to a toilet bowl discharge outlet and at another end to a toilet trap.

In another aspect the invention provides a toilet including a bowl having a lower discharge outlet, a trap in fluid communication with the discharge outlet, and a trap valve positioned to control outflow from the discharge outlet to the trap. The trap valve has a valve housing having an entry, an exit, and a cavity connecting the entry and exit. A gate valve is positioned in the cavity and pivotable using a linkage that extends from outside the valve housing to the cavity.

A sealing gasket is positioned adjacent the valve housing entry, wherein the gate valve is pivotable from a first position essentially closing off outflow from the discharge outlet to a second position permitting flow from the discharge outlet to the trap. The gate valve is linked to the linkage via a ball and socket arrangement.

In some embodiments, the present invention advantageously minimizes the tendency of the gate valve to abrade the sealing gasket, and helps to avoid leakage by placing the gate valve above the normal trap water level. Further, in those embodiments the closure requires little power as the gate is closing initially largely transversely to the flow out from the bowl, rather than directly upward.

In other embodiments a ball and socket joint is provided between the gate valve and its linkage so that as the gate valve closes it can correct for manufacturing tolerances or minor waste along the seal.

Additionally, should any maintenance issue arise with respect to the trap valve which requires replacement of the valve cartridge, or a component of it, the valve cartridge, or its component, can be replaced without having to dispose of the bowl or trap.

These and still other advantages of the present invention will be apparent from the detailed description which follows and the accompanying drawings. Hence, the following claims should be looked to in judging the invention.

DETAILED DESCRIPTION OF THE PREFERRED EMBODIMENTS

Figure 1:
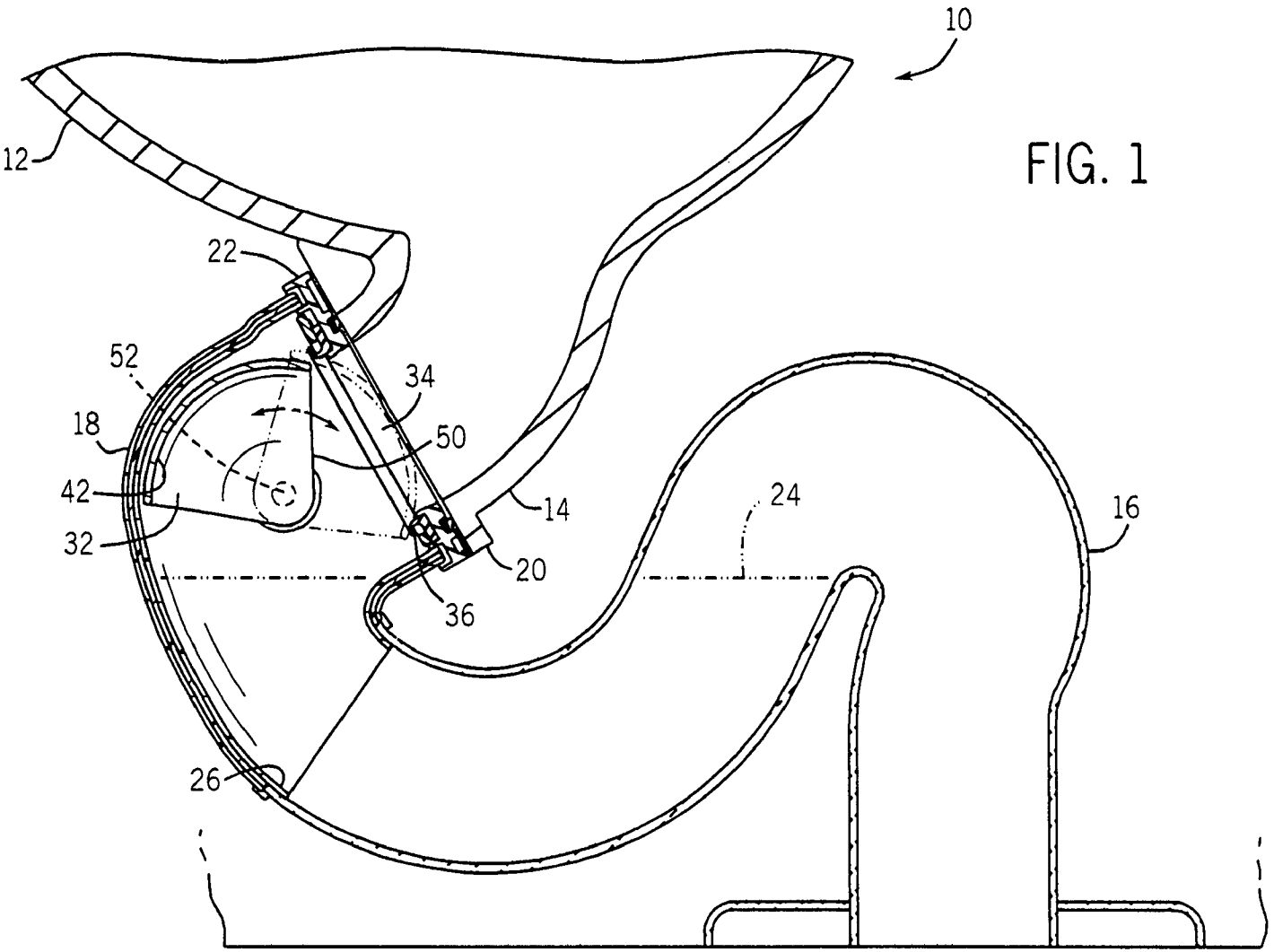
FIG. 1 is a vertical cross-sectional view through a portion of a lower toilet bowl and trap assembly constructed in accordance with the present invention.

Referring first to FIG. 1, there is shown the lower portion of a toilet generally 10, where there is the usual toilet bowl 12 with discharge outlet 14. Toilet 10 can otherwise be of a conventional construction.

For example, the toilet above the discharge outlet could have a structure analogous to that of U.S. Pat. No. 5,345,618, the disclosure of which is incorporated by reference as if fully set forth herein. Thus, there can be electrical or mechanical flush controls, including linkages from those controls to the trap valve 18. Alternatively, one could move the trap valve manually.

In any event, in the present embodiment, there is also a trap 16 in fluid communication with discharge outlet 14, and a trap valve 18 located downstream of bowl 12 and upstream of trap 16. Toilet 10 preferably includes a flange 20 near the bottom of bowl discharge outlet 14, and other connecting elements such as fasteners for connecting to the cartridge form trap valve 18 at flange 22.

Trap 16 has a normal trap water level 24 for preventing return of sewer gas, and can be connected to trap valve 18 at collar 26 with a flexible piece of rubber and/or other connector elements such as clamps (not shown). Trap valve 18 permits the passage of waste and fluid from bowl 12 to trap 16 when in the FIG. 1 open position.

Figures 2, 3:
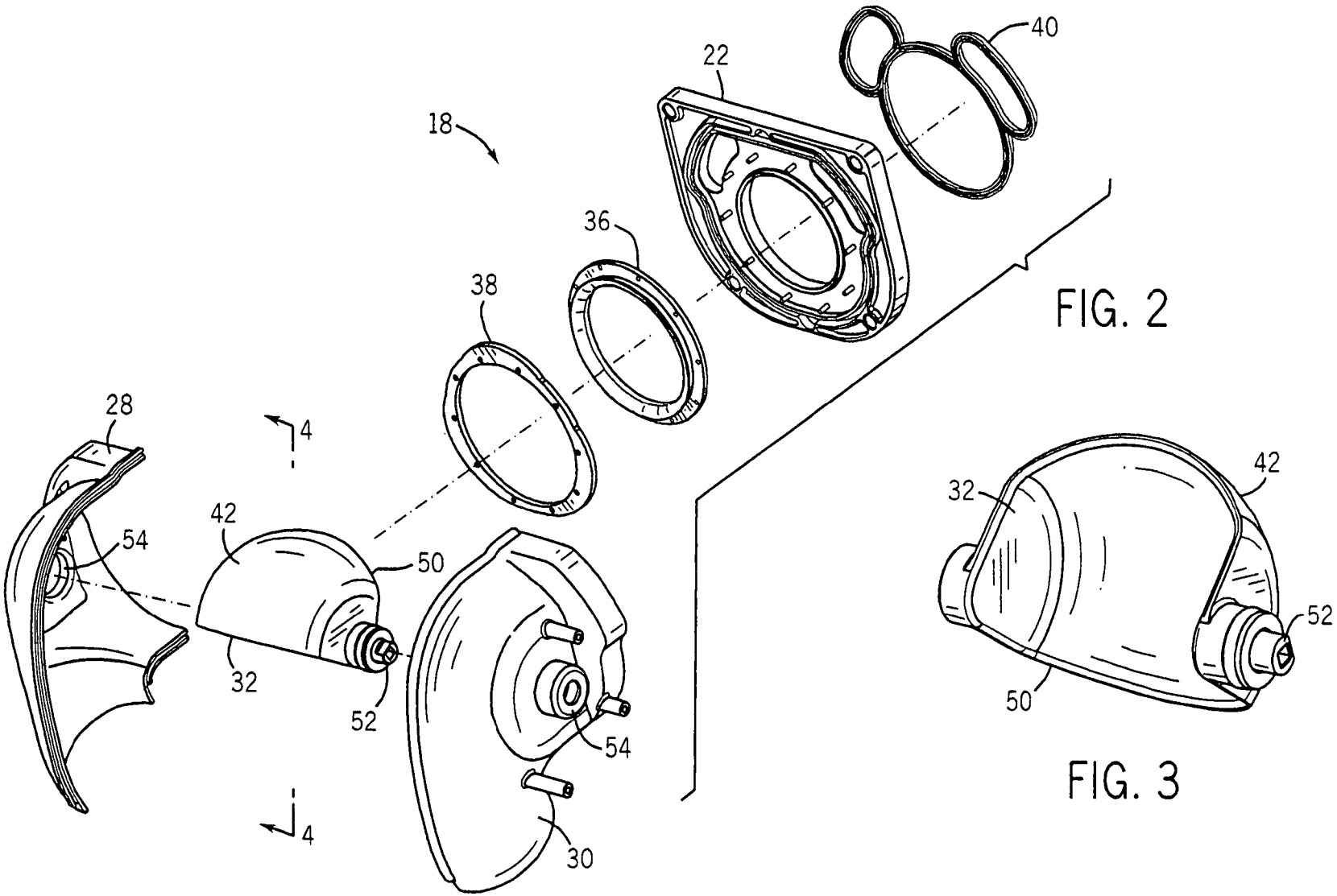
FIG. 2 is an exploded perspective view of a trap valve cartridge depicted in FIG. 1.
FIG. 3 is a perspective view of a gate valve of the FIG. 2 trap valve, the gate valve being viewed from a different perspective than as shown in FIG. 2.

Referring to FIGS. 1-3, trap valve 18 includes a first clamshell housing part 28, and a second generally mirror image clamshell housing part 30 connectible to first clamshell housing part 28. There is also a pivotable gate valve 32 mounted inside a cavity defined by the first and second clamshell housing parts 28/30.

Figure 5:
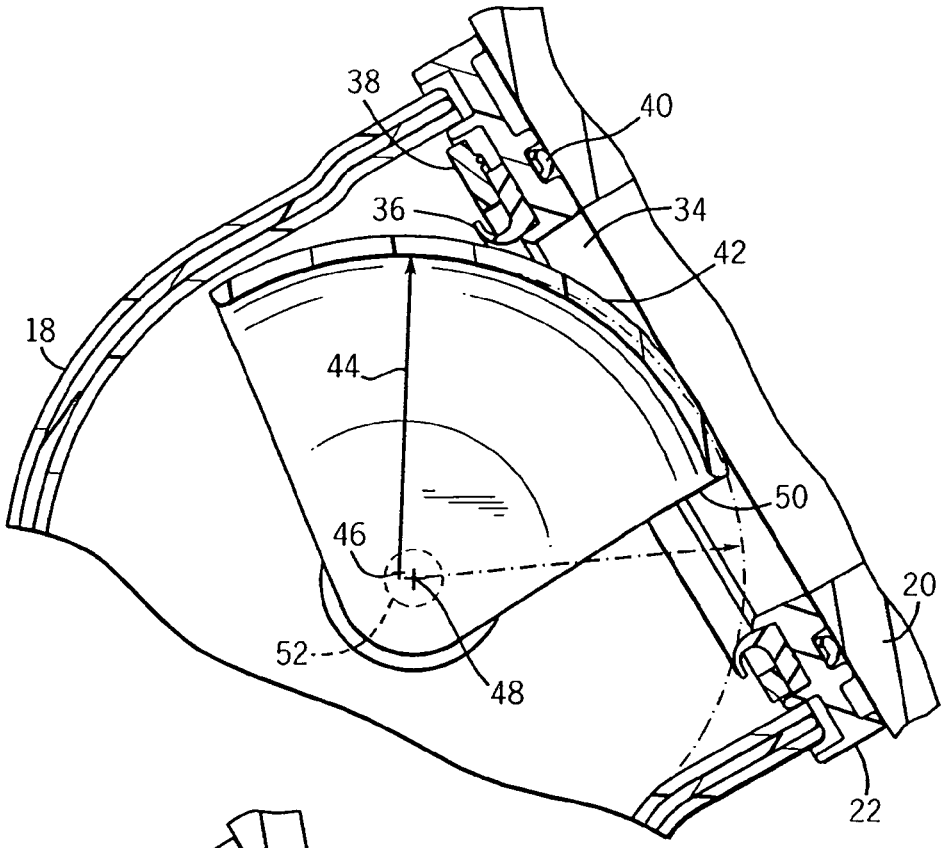
FIG. 5 is a further enlarged fragmentary cross-sectional view of a portion of FIG. 1, albeit now showing the gate valve in the process of closing.
Figure 6:
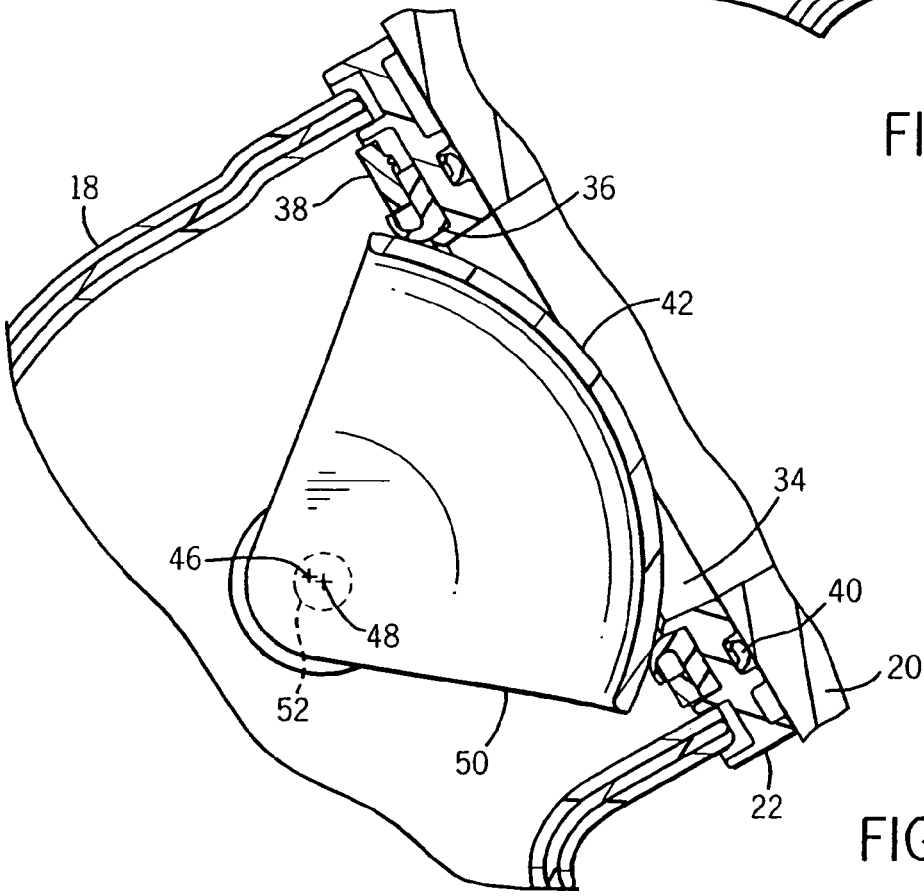
FIG. 6 is a view similar to FIG. 5, but with the gate valve now fully closed.

This cavity has an inlet orifice/entry 34 (see FIG. 1) which includes at least one gasket 36, 38, 40 surrounding inlet orifice 34. Pivotable gate valve 32 is positioned in the cavity so as to be able to move between a first closed position blocking inlet orifice 34 between flushes (FIG. 6), and an essentially open position (FIG. 1), and then a return position beginning to close off flow (as shown in FIG. 5).

Pivotable gate valve 32 preferably includes an essentially spherical contact segment 42 which has a radius of curvature 44 (FIG. 5) extending from a center of curvature 46. Pivotable gate valve 32 rotates about a center of rotation 48 offset from center of curvature 46, which results in a slightly eccentric rotation of gate valve 32 relative to its closure position. This allows spherical contact segment 42 to contact the sealing surface of gasket 36 fully only when gate valve 32 is in approximately the FIG. 6 position.

This means that the gate valve will not continuously scrape across the gasket 36 throughout the full swing of the gate valve closure. Rather, it closes in on the gasket sealing surface in an eccentric manner, thereby reducing wear and maintenance issues.

Moreover, the leading edge of the gate 50 cuts across the water exiting from the bowl transversely, rather than pushing up perpendicularly to the flow. This facilitates closure by helping to minimize the needed force to fight the effects of gravity.

Figure 4:
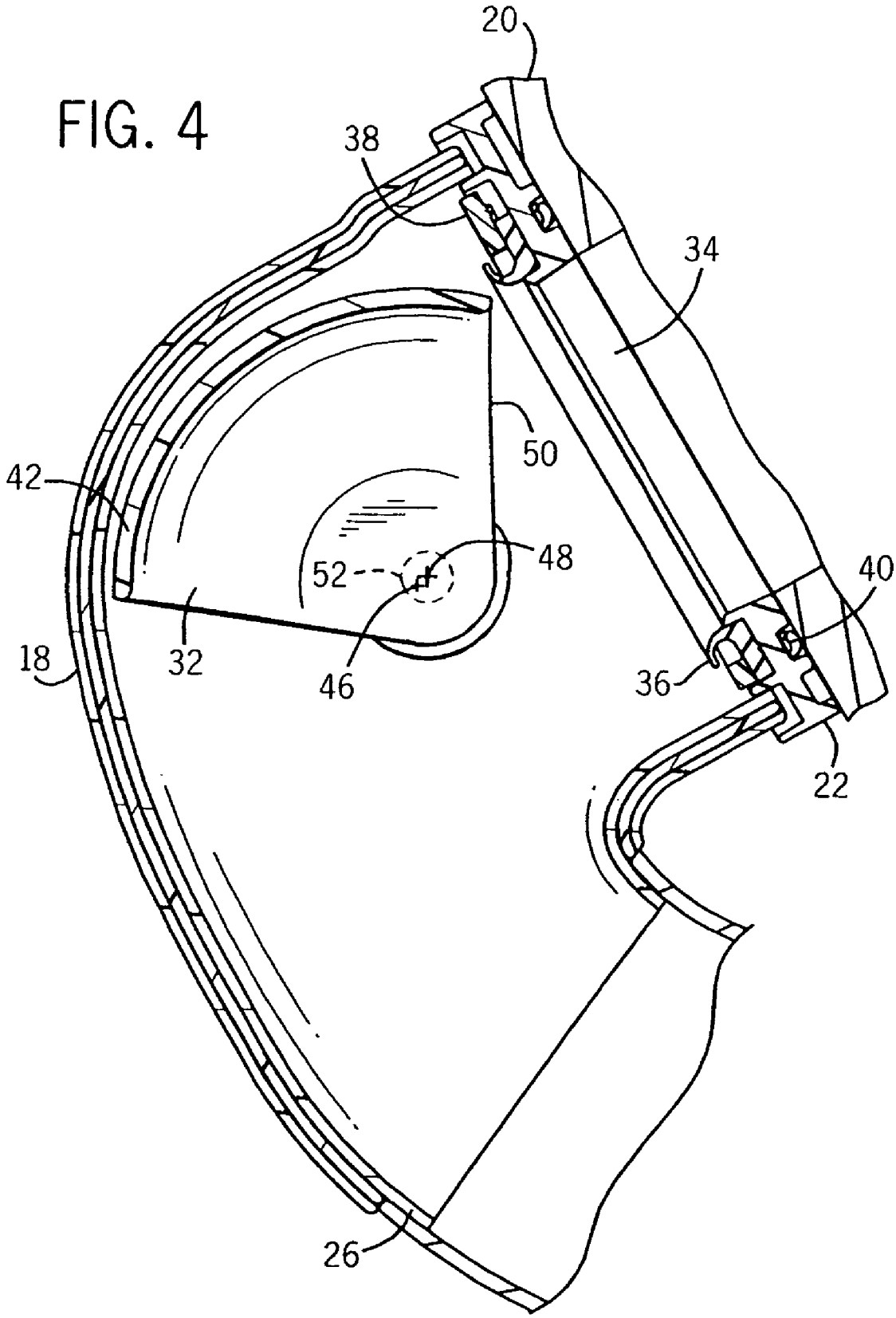
FIG. 4 is an enlarged, fragmentary, cross-sectional view of a portion of FIG. 1.

Most preferably, pivotable gate 32 has a leading edge 50 approximately between +40° and −40° (most preferably between +25° and −25°) from vertical when gate valve 32 is in the FIG. 4 position. Thus, leading edge 50 is approximately vertical when gate 32 begins to reduce the opening during closure.

As shown in FIGS. 1-6, gate valve 32 can comprise an approximately quarter spherical segment 42. Further, pivoting of the gate valve 32 can be caused by movement of a stem 52 that extends outside of housing parts 28, 30 and into the cavity.

Pivotable gate valve 32 can be positioned so as to always be above normal trap water level 24. This helps avoid having the trap valve components soak in sullied water between flushes, thereby reducing maintenance and leakage concerns. Also, waste does not tend to collect between the gate valve 32 and its cartridge cavity pocket. This reduces the resistance to opening which would occur if that would happen.

Stem 52 is connected to sockets 54 so that during a flushing cycle one trips a flush initiator connected to stem 52, which ultimately pivots the gate valve 32 out of the closed position. This permits waste to rapidly evacuate through inlet 34 of the valve cartridge. It is preferred that the start of the flush water be delayed slightly to permit most of the evacuation to occur before clean flush water starts to rinse the bowl.

After a defined period, trap valve 18 can have its gate valve 32 be caused to return to the FIG. 6 closed position, and preferably be latched in that position so that some water will remain in the bowl above gate valve 32 between flushes. The inlet water will then be shut off, ending the flush cycle.

Figure 7:
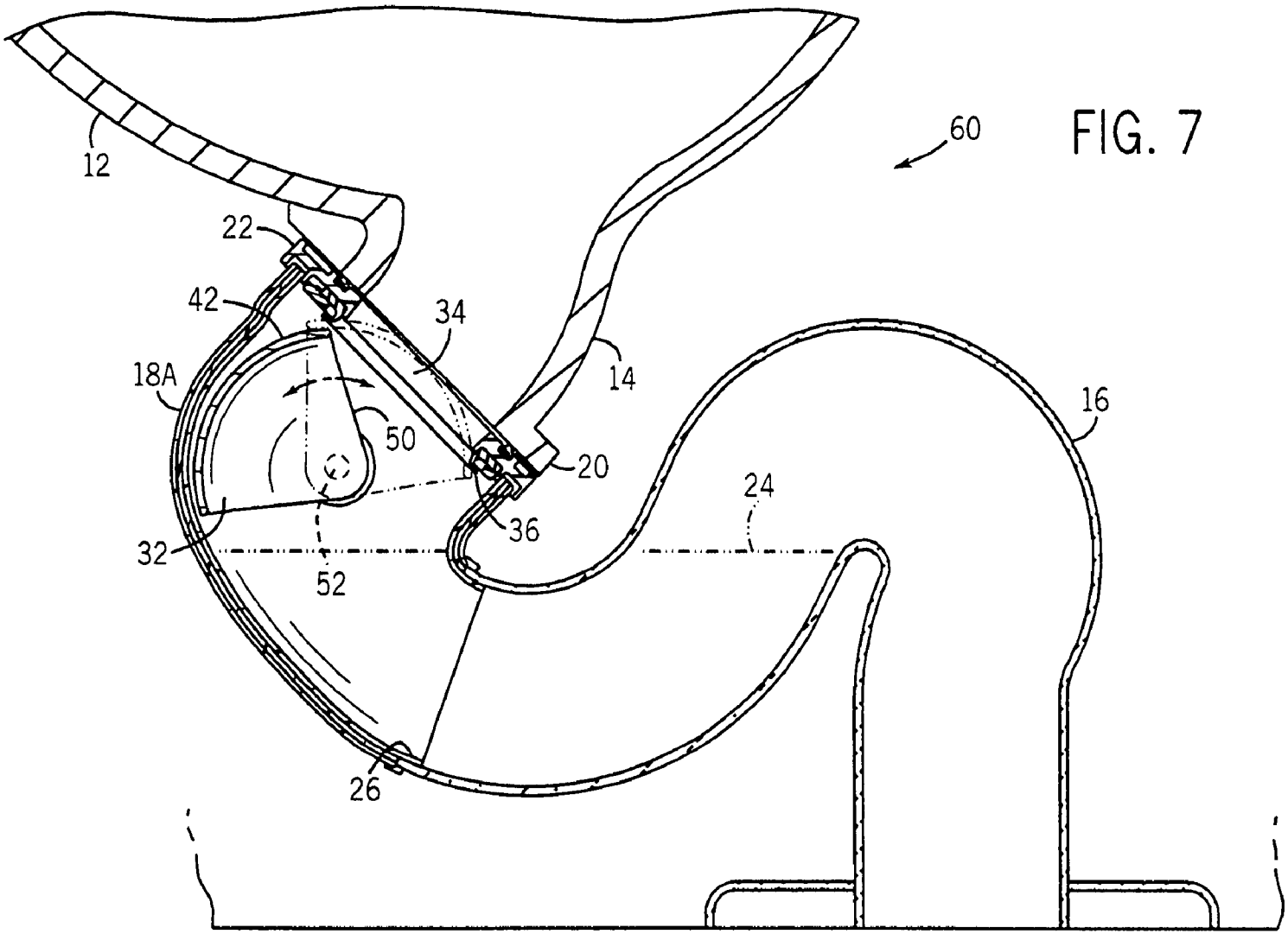
FIG. 7 is a view similar to FIG. 1, but of a second embodiment where the cartridge is attached to the bowl at a slightly different angle.

In the embodiment shown in FIG. 7, toilet 60 depicts trap valve cartridge 18A being at a slightly different angle of installation when compared to FIG. 1. Other elements are substantially the same as in FIG. 1, and hence are numbered in similar fashion.

Figure 8:
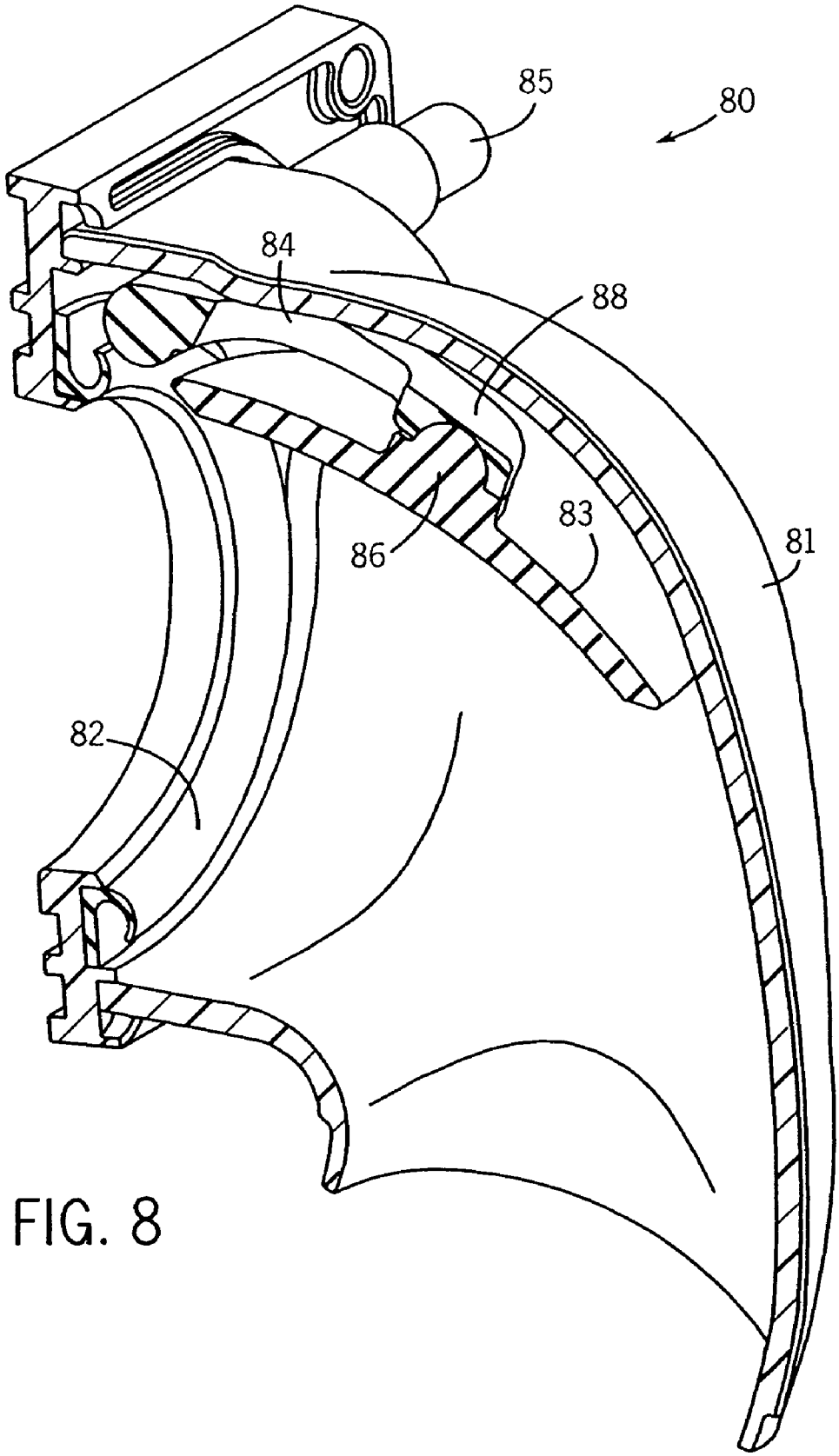
FIG. 8 is a perspective, cross-sectional view of another embodiment of a valve according to the present invention.

In the embodiment shown in FIG. 8, a trap valve 80 is positioned to control outflow from the discharge outlet of a toilet to the trap of the toilet. Trap valve 80 includes a housing 81 having an entry, an exit, and a cavity connecting the entry and exit. A sealing gasket 82 is positioned adjacent the valve housing entry. A gate valve 83 is positioned in the cavity and is pivotable using a linkage 85 that extends from outside the housing 81 to the cavity. Gate valve 83 is pivotable from a first position essentially closing off outflow from the discharge outlet to a second position permitting flow from the discharge outlet to the trap. There is an arm 84 connected to linkage 85, the arm being pivotably connected to gate valve 83.

In the embodiment shown in FIG. 8, the connection between arm 84 and gate valve 83 is a ball 86 and socket 88 arrangement. This allows the position of gate valve 83 to adjust as it is pressed against sealing gasket 82 in the closed position, and therefore increases the chances that the gate valve 83 seals (by making it less susceptible to assembly tolerances and minor debris on the seal).

Regardless of the embodiment, the present invention facilitates use of a trap valve to control toilet bowl evacuation. Maintenance concerns relating to wear on a sealing gasket are reduced by the eccentric closure. The positioning of the gate valve near vertical as the closure gate starts in some embodiments facilitates closure in the face of the weight of the bowl material. Positioning of the gate valve above the trap water level further reduces maintenance issues and helps with reliability.

The cartridge valve can be made of metal or plastic components.

While preferred embodiments of the present invention have been disclosed, it should be appreciated that still other modifications and variations to the preferred embodiments will be apparent to those skilled in the art, and are intended to be within the spirit and scope of the invention. For example, while the cartridge valve is preferably used with a ceramic bowl and trap, it can also be used with toilet components made of other materials (e.g. metallics; plastics). Further, the angle of installation of the trap valves 18/18A and gate 32 can vary somewhat.

Therefore, the present invention is not to be limited to just the described most preferred embodiments. To ascertain the full scope of the invention, the claims which follow are referenced.

INDUSTRIAL APPLICABILITY

The invention provides toilets which have improved trap discharge valves.

We claim:

1. A toilet, comprising:

a bowl having a lower discharge outlet;

a trap in fluid communication with the discharge outlet; and a trap valve positioned to control outflow from the discharge outlet through the trap, the trap valve comprising:

a valve housing having an entry, an exit, and a cavity connecting the entry and exit;

a gate valve positioned in the cavity and pivotable using linkage that extends from outside the valve housing to the gate valve; wherein the gate valve is in a form of a spherical segment having a radius of curvature extending from a center of curvature; and a sealing gasket;

wherein the gate valve is pivotable from a first position essentially closing off outflow from the discharge outlet to a second position permitting flow from the discharge outlet to the trap;

wherein the gate valve is positioned relative to the sealing gasket so as to begin closing off the entry when a lead edge of the gate valve is within 40° of vertical; and wherein the gate valve is mounted to the valve housing so that it is linked to the valve housing so as to pivot relative thereto about a center of rotation offset from said center of curvature to thereby create an eccentric closure of the gate valve against the sealing gasket which helps reduce scraping of the gate valve against the sealing gasket as the gate valve closes; and wherein said trap has a normal trap water level to restrict back flow of sewer gases to the bowl, and the gate valve is positioned so as to be entirely above that water level in both the first position and a fully open position.

2. The toilet of claim 1, wherein the sealing gasket is positioned adjacent the valve housing entry.

3. The toilet of claim 1, wherein the gate valve is positioned relative to the gasket so as to begin closing off the entry when a lead edge of the gate valve is within 25° of vertical.

4. The toilet of claim 1, wherein the valve housing includes a first housing portion coupled to a second housing portion thereby defining the cavity.

5. The toilet of claim 4, wherein the first housing portion is substantially symmetric to the second housing portion.

6. The toilet of claim 4, wherein the first and second housing portions include a socket for receiving the linkage to pivot therein.

7. The toilet of claim 1, wherein pivoting of the gate valve can be initiated as part of a flush cycle of the toilet.

8. The toilet of claim 1, further comprising a flange for coupling the valve housing to the discharge outlet of the bowl.

9. The toilet of claim 8, wherein the sealing gasket is a first gasket located between the flange and the valve housing and the toilet further comprises a second gasket provided between the first gasket and the valve housing.

10. The toilet of claim 9, further comprising a third gasket provided between the flange and the discharge outlet of the bowl on an opposite side of the flange as the first gasket.

11. The toilet of claim 1, wherein the sealing gasket has a J-shaped cross-section having a curved portion that extends from a straight portion.

12. The toilet of claim 11, wherein the curved portion of the sealing gasket provides a line of contact with the gate valve when the gate valve is rotated into contact with the sealing gasket.

13. A toilet, comprising:

a bowl having a lower discharge outlet;

a trap in fluid communication with the discharge outlet;

a trap valve positioned to control outflow from the discharge outlet through the trap, the trap valve comprising:

a valve housing having an entry, an exit, and a cavity connecting the entry and exit;

a gate valve positioned in the cavity and pivotable using linkage that extends from outside the valve housing to the gate valve, wherein the gate valve is in a form of a spherical segment having a radius of curvature extending from a center of curvature; and a first sealing gasket having a curved portion;

a flange for coupling the trap valve to the discharge outlet; and a second sealing gasket provided between the flange and the discharge outlet;

wherein the gate valve is pivotable from a first position essentially closing off outflow from the discharge outlet to a second position permitting flow from the discharge outlet to the trap; and wherein the gate valve is mounted to the valve housing so that it is linked to the valve housing so as to pivot relative thereto about a center of rotation offset from said center of curvature to thereby create an eccentric closure of the gate valve against the curved portion of the sealing gasket which helps reduce scraping of the gate valve against the sealing gasket as the gate valve closes; and wherein said trap has a normal trap water level to restrict back flow of sewer gases to the bowl, and the gate valve is positioned so as to be entirely above that water level in both the first position and a fully open position.

* * * * *